US007241032B2

(12) United States Patent
Qingbiao

(10) Patent No.: US 7,241,032 B2
(45) Date of Patent: Jul. 10, 2007

(54) READILY REPAIRABLE LAMP INCLUDING A LIGHT EMITTING DIODE (LED)

(75) Inventor: Wu Qingbiao, Fujian (CN)

(73) Assignee: Jinjiang Wandaihao Toys Co., Ltd., Fujian (CN)

( * ) Notice: Subject to any disclaimer, the term of this patent is extended or adjusted under 35 U.S.C. 154(b) by 0 days.

(21) Appl. No.: 11/250,632

(22) Filed: Oct. 14, 2005

(65) Prior Publication Data

US 2007/0041208 A1 Feb. 22, 2007

(30) Foreign Application Priority Data

Aug. 19, 2005 (CN) ..... 2005 2 0074833

(51) Int. Cl.
*F21S 19/00* (2006.01)
*H01R 13/74* (2006.01)

(52) U.S. Cl. ..... 362/382; 362/545; 362/654; 362/655; 439/375; 439/367

(58) Field of Classification Search ..... 362/800, 362/545, 115–120, 252, 654, 653, 644, 647
See application file for complete search history.

(56) References Cited

U.S. PATENT DOCUMENTS 5,361,192 A * 11/1994 Lai ..... 362/123
6,123,433 A * 9/2000 Chen ..... 362/654
6,878,015 B2 * 4/2005 Fan ..... 439/699.2
2002/0109989 A1 * 8/2002 Chuang ..... 362/226

* cited by examiner

*Primary Examiner*—Renee Luebke
*Assistant Examiner*—Evan Dzierzynski
(74) *Attorney, Agent, or Firm*—James J. Zhu; Perkins Coie LLP

(57) ABSTRACT

A lamp includes a lamp cover, a light emitting diode (LED), and a lamp holder, wherein the lamp holder includes an inner cover and an outer cover. The inner cover includes a pair of movable parts each having a top portion and a bottom portion. Two longitudinal channels are formed through the internal space of the inner cover and are in communication with through holes in the top portion and the bottom portion. The LED legs extend downwardly through the through holes of the top portion and make electrical contact, in the longitudinal channels, with lead wires projecting upwardly through the through holes in the bottom portion. The inner cover is inserted into the outer cover to form an annular groove intermediate the outer wall surface of the inner cover and the inner wall surface of the outer cover. The lamp cover head is mounted in the annular groove.

5 Claims, 3 Drawing Sheets

READILY REPAIRABLE LAMP INCLUDING A LIGHT EMITTING DIODE (LED)

CROSS-REFERENCE TO RELATED APPLICATION

The present application claims priority to Chinese Patent Application No. 200520074833.9, filed Aug. 19, 2005, the disclosure of which is incorporated by reference herein in its entirety, including drawings.

FIELD OF THE INVENTION

The present invention is directed to a lamp, and more particularly to a lamp including a light emitting diode (LED) as the lighting source.

BACKGROUND

Lamps with an LED light source typically include a lamp cover, the LED, and a lamp holder. The LED is positioned inside the lamp cover and has two legs extending out of a head of the lamp cover through attached lead wires. The lamp cover head is then put in a machine for injection, forming a lamp holder within which the lamp cover head and the lead wires are tightly enclosed. Producing a lamp in this manner is relatively difficult and complicated. Additionally, if the LED or the lamp cover breaks, a professional tool is generally required to split open the lamp holder and to replace the broken part. The lamp holder must then be injected again.

BRIEF SUMMARY

A lamp including an LED light source is configured such that it is easy to assemble and to repair. The lamp includes a lamp cover, an LED, and a lamp holder. The lamp holder includes an inner cover and an outer cover, with the inner cover including two or more insulating movable parts each having a top portion and a bottom portion. Two longitudinal channels are formed through the top portion and the bottom portion of each of the insulating movable parts in a position adjacent to and isolated relative to each other. Two or more openings or through holes are formed on the top portion and the bottom portion of each of the insulating movable parts.

The LED legs extend through the through holes of the top portion and are held in engagement, in the longitudinal channels, with lead wires projecting in an upward direction through the through holes of the bottom portion. The inner cover with the embedded lead wires is positioned in the outer cover to form an annular groove intermediate to the outer wall surface of the inner cover and the inner wall surface of the outer cover. The lamp cover head is mounted in the annular groove. Both the annular groove and the lamp cover head preferably include spiral threading for engagement with each other.

Each of the movable parts is preferably in the form of a semi-cylindrical body and is provided with four (or a different number of) semicircular holes, with two holes located in the top portion and two holes located in the bottom portion. The internal space of one of the movable parts includes an insulation projection that separates the internal space into two longitudinal channels. A groove extending in a longitudinal direction along the center of the corresponding movable part accommodates the insulation projection. Circular openings or through holes are formed by merging two of the semicircular holes such that each of the through holes is in communication with a longitudinal channel on one of the sides of the insulation projection.

A directive block is provided at the top portion of each of the longitudinal channels. The directive blocks form two narrow slots into which the LED legs enter via the through holes. A pair of directive grooves is formed at corresponding positions on the other movable part for accommodating the insulating directive blocks. An end of each lead wire includes a conductive plate that is held in engagement with an LED leg at the narrow slot.

A pair of convex flanges is formed at the lower end of each of the longitudinal channels. Corresponding convex flanges, central to each pair of convex flanges, are formed at corresponding positions on the other movable part having the insulation projection. Each pair of convex flanges and its corresponding convex flange are positioned in opposed relation to each other in their respective longitudinal channels.

One method of assembling the LED lamp includes positioning each of the conductive plates in the corresponding narrow slots, and combining the two movable parts end-to-end to form an inner cover. The inner cover is then inserted into the outer cover. Next, the LED legs are inserted through the through holes in the top portion of the inner cover. The insulating directive blocks guide each of the LED legs toward a respective narrow slot such that the LED legs make electrical contact with the embedded conductive plates. The lamp cover head is then screwed or otherwise mounted into the annular groove intermediate to the inner cover and the outer cover.

Aside from being relatively easy to assemble, the LED lamp is also relatively easy to repair. If a lamp cover is broken, the lamp cover can be unscrewed from the annular groove and replaced with a new lamp cover. If an LED is broken or otherwise inoperable, the lamp cover can be unscrewed from the annular groove, and the LED can be pulled out of the through holes located at the top portion of the inner cover. A new LED can then be added to replace the bad LED. If a conductive plate has a failure contact with a lead wire or LED leg, the lamp cover can be unscrewed from the annular groove, the outer cover can be removed from the inner cover, and the two movable parts of the inner cover can be loosened. The conductive plate can then be removed so that it can be repaired. All of these repairs are convenient and may be performed without damaging any portion of the LED lamp.

Other features and advantages of the invention will appear hereinafter. The features of the invention described above can be used separately or together, or in various combinations of one or more of them. The invention resides as well in sub-combinations of the features described. Furthermore, many of the method steps described herein may be performed in a different order than that which is explicitly described.

DETAILED DESCRIPTION OF THE INVENTION

Figure 1:
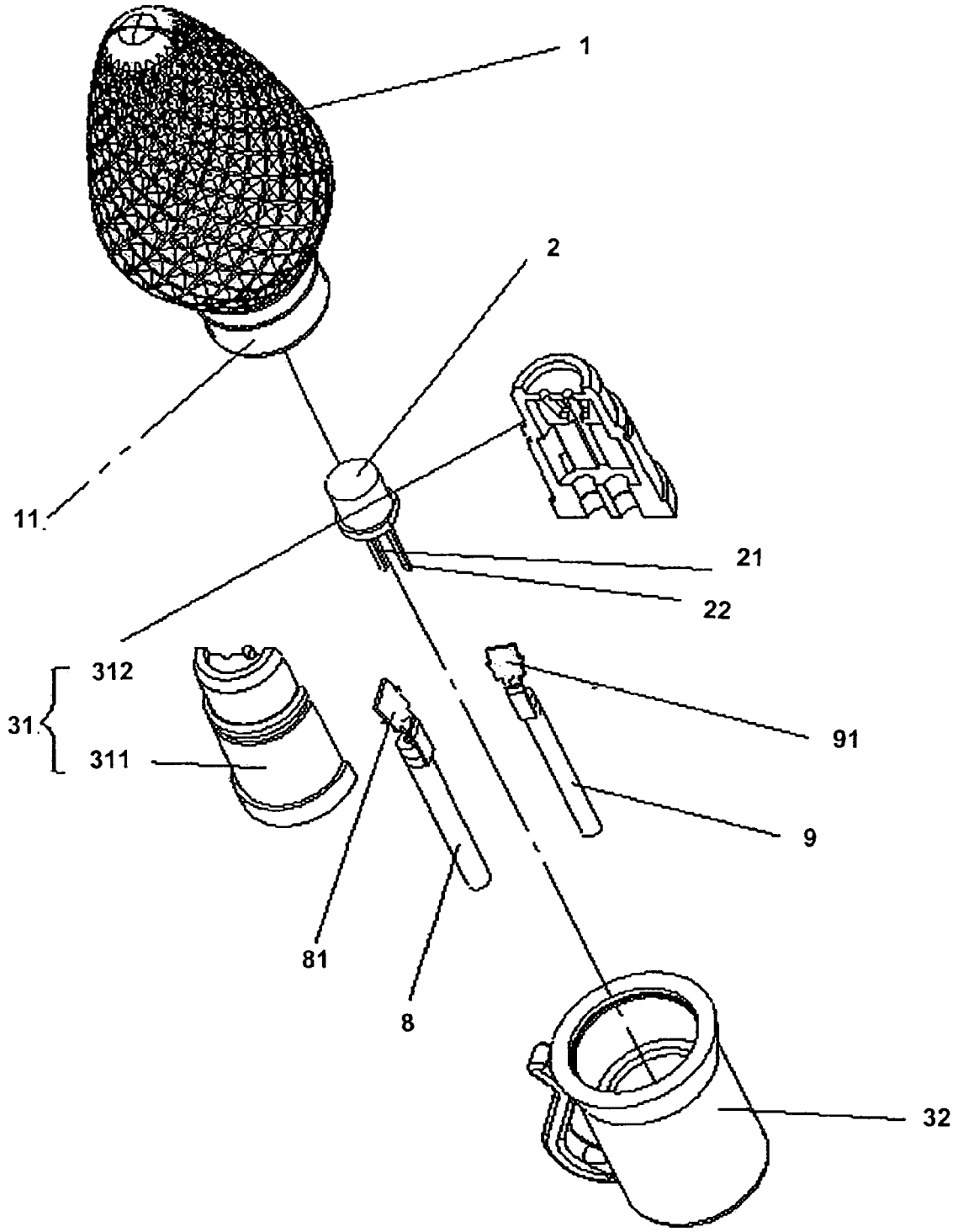
FIG. 1 is a fragmentary, sectioned, perspective view of an LED lamp according to one embodiment.
Figure 2:
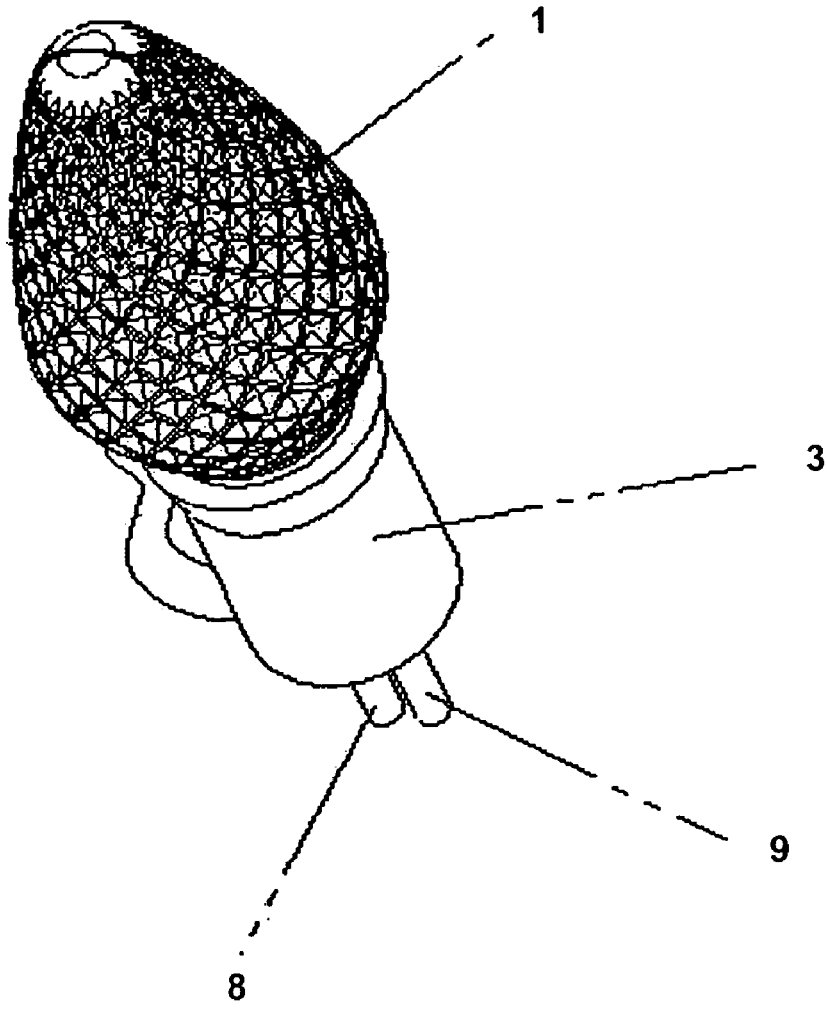
FIG. 2 is an assembled perspective view of the LED lamp illustrated in FIG. 1.

Referring to FIGS. 1 and 2, an LED lamp includes a lamp cover 1, a light emitting diode 2, and a lamp holder 3. The lamp holder 3 includes an inner cover 31 and an outer cover 32.

Figure 3:
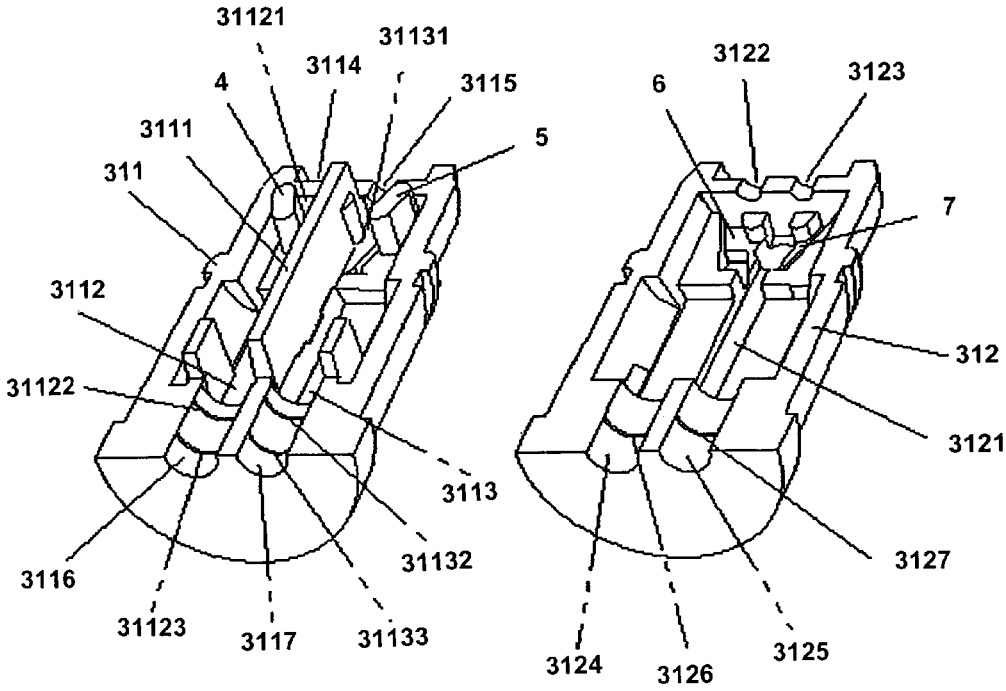
FIG. 3 is a perspective view of two sections of an inner cover of the LED lamp illustrated in FIG. 1.

Referring to FIG. 3, the inner cover 31 includes two movable parts 311 and 312, which may each have the form of a semi-cylindrical body having a top portion and a bottom portion. Both the top portion and the bottom portion of each of the movable parts 311 and 312 include two or more semicircular holes 3114, 3115, 3116, 3117 and 3122, 3123, 3124, 3125, respectively.

The internal space of the movable part 311 includes an insulation projection 3111 extending along the centerline of the movable part 311 in a longitudinal direction to form two longitudinal channels 3112, 3113. The internal space of the other movable part 312 is recessed with a groove 3121 for engagement with the insulation projection 3111 of the movable part 311. The movable part 311 and the other movable part 312 are attached or otherwise combined to form the inner cover 31. When the inner cover 31 is formed, four corresponding pairs of the semicircular holes 3114, 3115, 3116, 3117 and 3122, 3123, 3124, 3125 align with each other to form four circular openings or through holes. Two of the openings are located at the upper edge of the inner cover 31, and two of the openings are located at the bottom edge of the inner cover 31. These four through holes are in communication with the longitudinal channels 3112, 3113 at the two sides of the insulation projection 3111.

The ends of the longitudinal channels 3112, 3113 of the movable part 311 include insulating directive blocks 4, 5. The insulating directive blocks 4, 5 shape the space adjacent thereto into two narrow slots 31121, 31131. A pair of directive grooves 6, 7, at an angle of inclination, is located at an end of the other movable part 312 for accommodating the pair of insulating directive blocks 4, 5. Two conductive plates 81, 91, each associated with an end of a lead wire 8, 9, are held in engagement with two legs 21, 22 of the light emitting diode 2 at the narrow slots 31121, 31131. The two legs 21, 22 of the light emitting diode 2 and the lead wires 8, 9 are inserted in downward and upward directions, respectively, into the inner cover 31 via the through holes located in the upper edge and the bottom edge of the inner cover 31.

The longitudinal channels 3112, 3113 each include a pair of convex flanges 31122, 31123 and 31132, 31133 located at a position where the lead wires 8, 9 pass through the longitudinal channels 3112, 3113. The interior of the movable part 312 is provided with convex flanges 3126, 3127 that are located central to the convex flanges 31122, 31123 and the convex flanges 31132, 31133 when the two movable parts 311, 312 are attached to, or otherwise combined with, each other. The convex flanges are used to securely hold the lead wires 8, 9 within the longitudinal channels 311, 312 to eliminate stress between the lead wires 8, 9 and the conductive plates 81, 91. Because the lead wires 8, 9 are secured within the longitudinal channels 311, 312, a secure engagement occurs between the conductive plates 81, 91 of the lead wires 8, 9 and the LED legs 21, 22.

The top portion of the inner cover 31 is configured to fit into the lamp cover head 11, and the bottom portion of the inner cover 31 is configured to insert into the outer cover 32 with its outer surfaces bearing against the inner wall surface of the outer cover 32. The top portion of the inner wall surface of the outer cover 32 is adapted for holding the lamp cover head 11. When inserting the inner cover 31 into the outer cover 32, an annular groove is formed intermediate the outer wall surface of the inner cover 31 and the inner wall surface of the outer cover 32 into which the lamp cover head 11 is mounted. Both the annular groove and the lamp cover head 11 preferably include corresponding spiral threading for engagement with each other.

The outer wall surface of the inner cover 31 preferably includes a protruding convex loop, and the inner wall surface of the outer cover 32 preferably includes a corresponding positioning groove for receiving the convex loop and holding the inner cover 31 firmly in place.

One method of assembling the LED lamp includes positioning the conductive plates 81, 91 of the lead wires into respective narrow slots in the longitudinal channels of the movable part 311 including the insulation projection. The two movable parts 311, 312 are attached or combined end-to-end to form the inner cover 31, and the inner cover is then inserted into the outer cover 32. Next, the LED legs 21, 22 are inserted through the openings or through holes in the top portion of the inner cover 31. The directive blocks 4, 5 guide the LED legs 21, 22 toward the respective narrow slots so that the LED legs 21, 22 make electrical contact with the conductive plates 81, 91. The lamp cover head 11 is then screwed or otherwise mounted onto the annular groove formed intermediate the inner cover and the outer cover.

If the lamp cover is broken it may be unscrewed or otherwise removed from the annular groove and replaced with a new lamp cover. If the LED is broken or otherwise inoperable, the lamp cover may be unscrewed or otherwise removed from the annular groove, and the LED may be pulled out of the through holes located on the top surface of the inner cover. A new LED may then be inserted to replace the bad LED. If a conductive plate has a failure contact with a lead wire or LED leg, the lamp cover may be unscrewed or otherwise removed from the annular groove, the outer cover may be removed from the inner cover, and the two movable parts of the inner cover may be loosened with respect to each other. The conductive plate may then be removed so that it can be repaired. All of these repairs are convenient and may be performed without damaging any portion of the LED lamp.

Thus, while several embodiments have been shown and described, various changes and substitutions may of course be made, without departing from the spirit and scope of the invention. Many of the method steps described herein, for example, may be performed in a different order than that which is specifically described. The invention, therefore, should not be limited, except by the following claims and their equivalents.

What is claimed is:

1. A lamp, comprising:

a lamp cover including a lamp cover head;

an LED including a plurality of legs; and a lamp holder, comprising:

an outer cover;

an inner cover, comprising:

a pair of insulating movable parts having a top portion and a bottom portion;

a pair of longitudinal channels formed through the top portion and the bottom portion of the insulating movable parts in a position adjacent to and isolated relative to each other;

a plurality of through holes formed in the top portion and the bottom portion of each of the insulating movable parts;

wherein the LED legs extend through the through holes of the top portion and are held in engagement, in the longitudinal channels, with lead wires extending in an upward direction through the through holes in the bottom portion;

wherein the inner cover embedded with the lead wires is inserted into the outer cover to form an annular groove intermediate to an outer wall surface of the inner cover and an inner wall surface of the outer cover, with the lamp cover head mounted in the annular groove;

wherein each of the movable parts is in the form of a semi-cylindrical body having four semicircular holes, with two of the holes located in the top portion, and two of the holes located in the bottom portion, and wherein an insulation projection protrudes from an internal space of one of the movable parts in a longitudinal direction to separate the internal space into the pair of longitudinal channels, and wherein a groove extends along a center of the other movable part in a longitudinal direction to accommodate the insulation projection, with pairs of the semicircular holes combined together to form circular through holes each in communication with one of the longitudinal channels.

2. The lamp according to claim 1, wherein each of the longitudinal channels is provided with a pair of insulating directive blocks at a top portion thereof, wherein the insulating directive blocks shape an adjacent space, where the LED legs pass, into narrow slots, and wherein a pair of directive grooves is formed on a corresponding portion of the other movable part for accommodating the insulating directive blocks.

3. The lamp according to claim 2 further comprising conductive plates, associated with ends of the lead wires, that are held in engagement with the LED legs at the narrow slots.

4. The lamp according to claim 3 further comprising a pair of convex flanges formed on a lower end of each of the longitudinal channels, and a corresponding convex flange formed on the internal space of the other movable part in a position central to each pair of convex flanges, with each pair of convex flanges and its corresponding convex flange positioned in opposed relation with respect to each other in their respective longitudinal channels.

5. The lamp according to claim 4, wherein both the annular groove and the lamp cover head include spiral threading for engagement with each other.

* * * * *